United States Patent [19]

Brown

[11] 3,976,124

[45] Aug. 24, 1976

[54] COOLING-CONTROLLED TANK FOR HYDRAULIC FLUID

[75] Inventor: Wilburn Kelly Brown, Morton Grove, Ill.

[73] Assignee: Pettibone Corporation, Chicago, Ill.

[22] Filed: Nov. 21, 1974

[21] Appl. No.: 525,850

[52] U.S. Cl. ..... 165/35; 137/264; 137/375; 60/456; 60/DIG. 5

[51] Int. Cl.[2] ..... F25B 29/00

[58] Field of Search ..... 165/35, 36; 137/592, 137/574, 610, 340, 264, 375, 334, 339; 60/456, DIG. 5

[56] References Cited

UNITED STATES PATENTS

| | | | |
|---|---|---|---|
| 1,164,105 | 12/1915 | Lentz | 60/456 |
| 1,270,170 | 6/1918 | Kingsbury | 137/339 |
| 3,063,245 | 11/1962 | Rippy | 60/DIG. 5 |
| 3,196,926 | 7/1965 | Gartland | 137/339 |
| 3,772,896 | 11/1973 | Rao | 60/DIG. 5 |

*Primary Examiner*—Albert W. Davis, Jr.
*Assistant Examiner*—James D. Liles
*Attorney, Agent, or Firm*—Darbo, Robertson & Vandenburgh

[57] ABSTRACT

A tank for oil or other hydraulic fluid is improved both for cooling the fluid during normal operation and for heating it up preliminarily at start-up time by an internal curtain spaced a narrow distance from the side walls and providing a cooling channel through which, during operation, the oil may be passed in immediate contact with the outer side walls of the tank to be cooled before flowing into the main storage chamber, a flap valve being turned at start-up time to a position to direct returning oil directly into the main storage chamber where it is relatively insulated from the outer side walls by the stagnant oil in the cooling channel, so that the heat developed by power-circulation of the oil is conserved and in cold weather the oil is more quickly brought up to satisfactory operating temperature. The peripheral cooling channel normally used also settles foreign particles from the hydraulic fluid, and dissipates any entrained air at its surface. However, the tank is preferably kept under a few pounds of air pressure during operation to keep air from being drawn into the fluid and to aid its flow to the pump.

10 Claims, 4 Drawing Figures

COOLING-CONTROLLED TANK FOR HYDRAULIC FLUID

The invention of which the present disclosure is offered for public dissemination in the event adequate patent protection is available relates to oil reservoirs or storage tanks for heavy-duty hydraulic-power equipment. There has long been recognition that with such equipment there was a great need for cooling the oil to dissipate the heat developed in it in the course of performing the hydraulic-power operations. Various cooling systems have been used. Allowing the oil to reach too high a temperature may cause its deterioration and may even involve a fire hazard. There has also long been recognition of a problem of the opposite nature when starting up such systems in cold weather. Under such conditions, it has been necessary to circulate the oil for a substantial length of time before beginning to perform the power functions with it, so as to raise the temperature of the oil and lower its viscosity to an acceptable level. There is, of course, a desire to use hydraulic oil of reasonable price rather than expensive fluids the viscosity of which is substantially unaffected by temperatures likely to be encountered and which may be less satisfactory in some respects than the oil.

According to the present invention, a simple improvement in the storage tanks is of great benefit in meeting these two problems of opposite nature, and in improving the character of oil drawn from the tank. By installing in the storage tank, relatively closely spaced to the outer side walls, a vertical curtain providing a peripheral channel between it and the side walls, and installing a flap valve for choosing the course of the incoming oil, the oil may at will be cooled or heated more effectively than with conventional tanks. During normal operation, the incoming oil can be directed to flow through the channel between the curtain and the outer wall. After flowing through said channel nearly all of the way around the periphery of the tank, so as to receive maximum cooling by the outer side walls with which it flows in direct contact, the cooled oil flows into the main reservoir which is substantially surrounded by this curtain. Much more heat is thus dissipated through the side walls of the tank than has been the case heretofore, without the curtain, when the side walls of the tank were in contact with the relatively low average temperature of the total oil supply, in a relatively calm state, rather than to the higher temperature of the rapidly moving returning oil before being admixed with the stored oil. At start-up time, a flap valve is turned to direct the incoming oil directly into the main storage chamber without passing through the cooling channel. The oil in the cooling channel therefore remains relatively stagnant and actually acts as an insulator between the cold outer wall of the tank and the oil in the main storage chamber so that the heat developed by the start-up circulation of oil is conserved, and the oil temperature rises more rapidly than without the partition.

Aside from cooling, the cooling channel has an important advantage in improving the quality of the oil drawn from the tank. It is frequently the case that tiny air bubbles are entrained in the oil when it is returned to the tank, and heretofore some of these bubbles were drawn into the outflowing oil. Air in the oil is quite objectionable because it keeps the fluid from being the noncompressible fluid it should be. As the oil flows through the cooling channel, the air can rise by its buoyancy to the surface of the oil and be dissipated from the oil before the oil reaches the main storage area. Also, tiny metal particles are picked up by the oil as it performs its work, and some of these have sometimes been drawn into the outflow stream of oil. Though usually caught by the outflow screen, they tended to clog the screen and necessitated occasional cleaning. With the cooling channel in use, the metal particles will mostly settle within this channel and not reach the point where they could be drawn into the outflow.

The advantages and objects of the invention may be more apparent from the following description and from the drawings.

DESIGNATION OF FIGURES

INTENT CLAUSE

Figure 1:
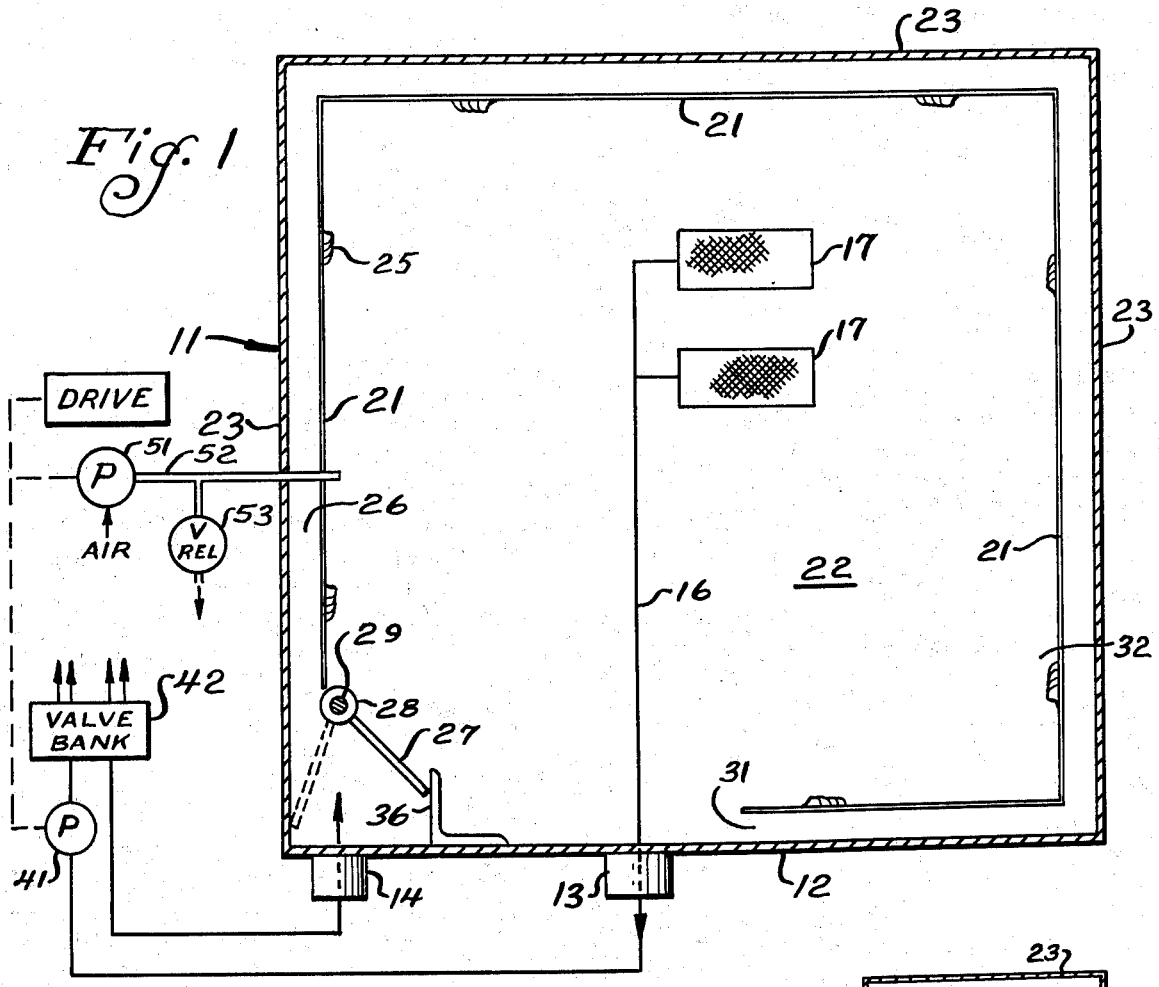
FIG. 1 is a downwardly looking cross-sectional view of one form of the tank chosen for illustration of this invention, with connections shown diagrammatically.
Figure 2:
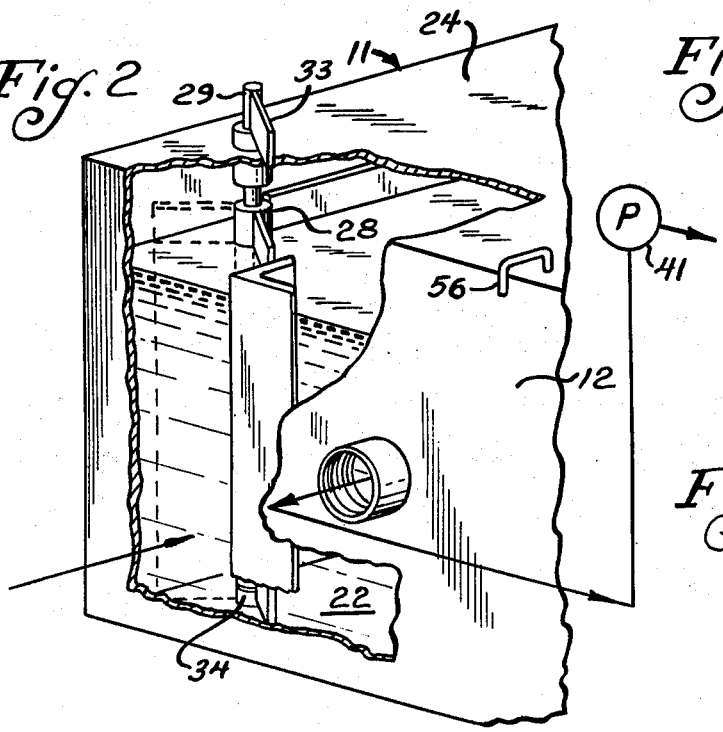
FIG. 2 is a partial perspective view of the tank partly broken away to show the flap valve.

Although the following disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

BACKGROUND DESCRIPTION

In some respects the tank 11 is conventional. Thus its outer structure is entirely of steel and it may have four vertical walls, a bottom wall and a top wall 24. One vertical wall 12 is provided with an outflow fitting 13 and a return or inflow fitting 14. As indicated by a diagrammatic line 16, the outflow fitting 13 is connected with filter means 17 through which oil is conventionally drawn from a little above the bottom of the tank. The top wall 24 of the tank is conventionally separable, though not so shown, to permit periodic cleaning out of the metal particles which gather on the floor of the tank and the screens.

COOLING AND SETTLING PASSAGE OF PRESENT INVENTION

According to the present invention a curtain 21 rests on the tank bottom 22 and extends nearly all of the way around the periphery of the tank 11, being spaced only a short distance from the side walls 12 and 23. Although this curtain 21 should be secured to the bottom 22 (as by tack welding 25) and should extend above the expected maximum liquid level in the tank, it need not have a leak-proof seal to the bottom surface and need not extend to the top wall 24. When desired, oil is directed to flow through the cooling and settling channel 26 between wall 21 and walls 23 and 12 by a flap valve 27 extending from one side of a hub tube 28 mounted on a shaft 29, to which it is firmly secured or keyed. After traversing the entire peripheral length of the cooling channel 26, to the discharge end 31 thereof, the oil flows into the main storage space 32 comprising the entire tank volume inside of the curtain 21.

Figure 3:
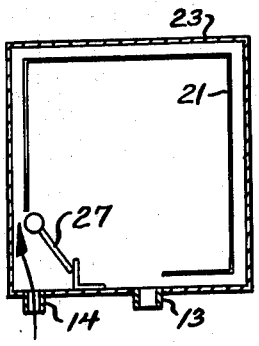
FIGS. 3 and 4 are flow diagrams to show the flow respectively for cooling of the oil and for heating it.
Figure 4:
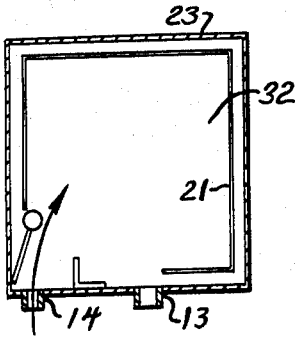

In cold weather, when the oil needs to be heated by circulating it before starting hydraulic operations, the flap valve 27 is turned from the position shown in FIG. 3 to the position shown in FIG. 4, which is also the dotted line position of FIG. 1. This swinging of the valve is accomplished by a handle 33 secured on shaft 29 which extends to the top wall 24 of the tank. The shaft 29 also extends into a collar 34 welded to the bottom 22 of the tank. With this position of the flap valve 27, oil can flow directly into main storage chamber 32, as seen in FIG. 4.

It is not necessary that the flap valve 27 seal tightly. In the cooling position it rests against a vertical jamb 36, which may be one angle of an angle bar welded to wall 12. In its other position it rests against the wall 23. The curtain 21 has a snug but preferably nonrubbing fit with tubular hub 28 for the full length of the hub, and below the hub may engage collar 34. Any slight leakage between the cooling channel 26 and the main storage space 32 is of no consequence. For this reason, it is sufficient that the curtain 21 have a snug fit with the bottom 22 without having a leak-proof seal. It will be observed that the curtain 21 is not significantly a load-bearing wall, and pressure on opposite faces are about equal. Hence it may be of thinner steel than the main or outer walls 12 and 23. It may even be of some different material, such as a plastic material or even a foam plastic material. Some manufacturers might prefer such materials of relatively low heat conductivity or which are thermally insulative, because in theory they could enhance the effect of the curtain according to the present invention. They are not necessary, however, for achieving very beneficial results. Indeed, the heat transfer through the oil just inside of curtain 21 is so slow that neither higher cost nor use of more space is believed to be justified by any insulative value of such materials.

The cross section of the cooling channel 26 is preferably from 10 to 30 times the cross section of the return fitting 14. One reason is so that the resistance to oil flow through the channel 26 will be extremely low, and yet the flow will have a sufficient speed to effect rapid heat transfer to the outer walls 23 and 12 so that in many hydraulic systems no other special cooling means will need to be provided. A suitable speed of flow in channel 26 is one foot per second. An important advantage of a speed this slow is in allowing metal particles to settle to the floor of the channel and air to rise and be dissipated into the air space above the oil while the oil is still too remote from screens or filters 17 to be drawn into the outflow.

According to another aspect of the invention, the amount of air in the oil is considerably reduced by pressurizing oil in the tank. Thus air pump 51 pumps air into air line 52 which discharges above the oil in tank 11. A relief valve 53 limits this air pressure to a desired value, such as 15 PSI. The pressure should be enough so that a positive pressure will be maintained at the shaft of oil pump 41 to prevent air from being drawn into the oil at this point, as is especially likely to occur as the shaft seal becomes worn.

Oil in such tanks has been pressurized before, but the past pressurizing by using a sealed tank and relying on a temperature increase for pressurizing has defects.

One defect is that the pressure increase is slow to develop and may be inadequate. Another is that the pressure remains after the operation has ceased and may cause oil leakage. Gravity pressurization by having the tank above the level of the oil pump is even worse as to oil leakage. Leakage may then continue throughout a night or weekend — or until the oil has all leaked out.

These faults are here overcome. By pressurizing with air pump 51 driven when the oil pump 41 is driven (by the same drive) the pressure is applied promptly upon start-up and ceases to be applied upon shutdown. A bleed-vent 53 is provided (unless leakage is dependable) to dissipate the pressure soon after the pump 51 stops. Tank 11 preferably has its maximum oil level below the level of pump 41, or its shaft, so that no oil will leak at this point by gravity.

ACHIEVEMENT

When oil is returned to the tank in heated condition through fitting 14 with the flap valve 27 in its cooling position, the oil flows at moderate speed through cooling channel 26 in direct contact with outside walls 23 and 12 so that these walls are held close to the temperature of the oil in contact with these walls at the successive points and therefore has maximum heat dissipation to the air. By the time the oil reaches the exit end 31 of channel 26, it will have been sufficiently cooled for re-use and will join the remaining oil in main storage chamber 32. Of course, some heat dissipation continues through the bottom wall of the tank and a lesser amount through the top wall of the tank.

During start-up time in cold weather, the flap valve 27 is manually turned to its heating position as shown in FIG. 4 and oil is circulated by pump 41 at least through valve bank 42 and back to the return fitting 14 where it flows directly into the main storage chamber 32, with minimum dissipation of the heat which has been beneficially developed by this forced circulation. Because this will usually be before hydraulic operations have started, the oil thus flowing into the main storage area 32 will be relatively free from metal particles.

During normal operation, when entraining of metal particles in the oil seems to be inevitable, they have a chance to settle out of the oil in the cooling channel. Thus there is far less chance that the metal particles will clog the filter screen, or even pass through it, than if part of the inflow could pass directly to the screen. Likewise, air bubbles can escape from the fluid in the cooling channel instead of having a good chance of being recirculated by being entrained in the part of the fluid flowing relatively directly from the inflow to the intake of the outflow. Because outflow 31 of the cooling channel faces tangentially, the oil tends to flow in a long spiral path toward filter means 17, which preferably should be nearer the center instead of as shown.

I claim:

1. A tank for hydraulic fluid formed of surrounding outer walls, an inflow connection through a wall of the tank and an outflow connection through a wall of the tank; said connections being adapted for connection to conduits of a high-pressure hydraulic system; curtain means spaced a relatively narrow distance from the walls of the tank to provide a heat-dissipation passage on the outer side thereof and a main storage chamber of the inner side of the curtain means; outflow means including the outflow connection for drawing hydraulic fluid from the main storage chamber through a filter; and selection means for selecting between directing hydraulic fluid from the inflow connection to said chamber by flow through the length of the heat-dissipation passage in contact with the outer walls, or directly to the main storage chamber.

2. A tank for hydraulic fluid formed of surrounding outer walls, an inflow connection through a wall of the tank and an outflow connection through a wall of the tank; said connections being adapted for connection to conduits of a high-pressure hydraulic system; curtain means spaced a relatively narrow distance from the walls of the tank to provide a heat-dissipation passage on the outer side thereof and a main storage chamber on the inner side of the curtain means; outflow means including the outflow connection for drawing hydraulic fluid from the main storage chamber through a filter; and selection means for selecting between directing hydraulic fluid from the inflow connection to said chamber by flow through the length of the heat-dissipation passage in contact with the outer walls, or directly to the main storage chamber; said curtain means resting on the bottom wall of the tank and snugly fitting it without being thoroughly sealed to it.

3. A tank for hydraulic fluid formed of surrounding outer walls, an inflow connection through a wall of the tank and an outflow connection through a wall of the tank; said connections being adapted for connection to conduits of a high-pressure hydraulic system; curtain means spaced a relatively narrow distance from the walls of the tank to provide a heat-dissipation passage on the outer side thereof and a main storage chamber on the inner side of the curtain means; outflow means including the outflow connection for drawing hydraulic fluid from the main storage chamber through a filter; and a flap valve for selecting between directing hydraulic fluid from the inflow connection to said chamber by flow through the length of the heat-dissipation passage in contact with the outer walls, or directly to the main storage chamber.

4. A tank for hydraulic fluid formed of surrounding outer walls, an inflow connection through a wall of the tank and an outflow connection through a wall of the tank; said connections being adapted for connection to conduits of a high-pressure hydraulic system; curtain means spaced a relatively narrow distance from the walls of the tank to provide a heat-dissipation passage on the outer side thereof and a main storage chamber on the inner side of the curtain means; outflow means including the outflow connection for drawing hydraulic fluid from the main storage chamber through a filter; and a flap valve for selecting between directing hydraulic fluid from the inflow connection to said chamber by flow through the length of the heat-dissipation passage in contact with the outer walls, or directly to the main storage chamber; said flap valve being stabilized in either position by kinetic force of the inflow.

5. A hydraulic system for use in cold conditions including a tank according to claim 1, a power-driven high-pressure pump connected to draw hydraulic fluid from the tank, and a conduit system connected to said pump and returning said fluid to said tank and in which heat is developed by resistance to the flow of the pumped hydraulic fluid.

6. A tank for hydraulic fluid formed of surrounding outer walls, an inflow connection through a wall of the tank and an outflow connection through a wall of the tank; said connections being adapted for connection to conduits of a high-pressure hydraulic system; curtain means spaced a relatively narrow distance from the walls of the tank to provide a heat-dissipation passage on the outer side thereof to carry inflowing fluid from the inflow connection along said passage to a main storage chamber on the inner side of the curtain means; and outflow means including the outflow connection for drawing hydraulic fluid from the main storage chamber through a filter; the flow cross-section of the heat-dissipation passage being at least several times that of the inflow connection to allow solids to settle to the bottom of the heat-dissipation passage.

7. A tank for hydraulic fluid formed of surrounding outer walls, an inflow connection through a wall of the tank and an outflow connection through a wall of the tank; said connections being adapted for connection to conduits of a high-pressure hydraulic system; curtain means spaced a relatively narrow distance from the walls of the tank to provide a heat-dissipation passage on the outer side thereof to carry inflowing fluid from the inflow connection along said passage to a main storage chamber on the inner side of the curtain means; and outflow means including the outflow connection for drawing hydraulic fluid from the main storage chamber through a filter; the flow cross-section of the heat dissipation passage being at least several times that of the inflow connection to allow solids to settle to the bottom of the heat-dissipation passage, and air to escape from the fluid by rising to its surface in the heat-dissipation passage.

8. A tank for hydraulic fluid formed of surrounding outer walls, an inflow connection through a wall of the tank and an outflow connection through a wall of the tank; curtain means spaced a relatively narrow distance from the walls of the tank to provide a cooling passage on the outer side thereof and a main storage chamber on the inner side of the curtain means; and outflow means including the outflow connection for drawing filtered hydraulic fluid from the main storage chamber; the flow cross-section of the cooling passage being at least several times that of the inflow connection to allow solids to settle to the bottom of the cooling passage, and air to escape from the fluid by rising to its surface in the cooling passage; and the discharge from the cooling passage into the main storage chamber being at the periphery of the latter and generally tangential to it to cause an inward spiral flow, the outflow means drawing from substantially further inward than the outer spiral.

9. A hydraulic system including a hydraulic pump, a tank for hydraulic fluid formed of surrounding outer walls, an inflow connection through a wall of the tank and an outflow connection through a wall of the tank and leading to the hydraulic pump at a level above the fluid level in the tank; curtain means spaced a relatively narrow distance from the walls of the tank to provide a cooling passage on the outer side thereof and a main storage chamber on the inner side of the curtain means; outflow means including the outflow connection for drawing filtered hydraulic fluid from the main storage chamber; the flow cross-section of the cooling passage being at least several times that of the inflow connection to allow metal particles to settle and air to rise and escape; and an air pump for pressurizing the fluid in the tank to supply the fluid to the hydraulic pump under pressure and minimize the sucking in of air.

10. A hydraulic system including a hydraulic pump, a tank for hydraulic fluid formed of surrounding outer walls, an inflow connection through a wall of the tank and an outflow connection through a wall of the tank and leading to the hydraulic pump at a level above the fluid level in the tank; curtain means spaced a relatively narrow distance from the walls of the tank to provide a cooling passage on the outer side thereof and a main storage chamber on the inner side of the curtain means; outflow means including the outflow connection for drawing filtered hydraulic fluid from the main storage chamber; the flow cross-section of the cooling passage being at least several times that of the inflow connection to allow metal particles to settle and air to rise and escape; and an air pump for pressurizing the fluid in the tank to supply the fluid to the hydraulic pump under pressure and minimize the sucking in of air; drive means for driving said air pump only while the hydraulic pump is driven; and means for promptly dissipating air pressure in the tank when the air pump is not driven.

* * * * *

UNITED STATES PATENT AND TRADEMARK OFFICE

CERTIFICATE OF CORRECTION

PATENT NO. : 3,976,124

DATED : August 24, 1976

INVENTOR(S) : Wilburn Kelly Brown

It is certified that error appears in the above-identified patent and that said Letters Patent are hereby corrected as shown below:

Column 4, line 65, "of", first occurrence, should be -- on --

Signed and Sealed this

Seventh Day of December 1976

[SEAL]

*Attest:*

RUTH C. MASON
*Attesting Officer*

C. MARSHALL DANN
*Commissioner of Patents and Trademarks*